US009356391B2

(12) United States Patent
Akagi

(10) Patent No.: US 9,356,391 B2
(45) Date of Patent: May 31, 2016

(54) PANEL-FIXED CONNECTOR DEVICE

(71) Applicant: YAZAKI CORPORATION, Tokyo (JP)

(72) Inventor: Yosuke Akagi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/421,104

(22) PCT Filed: Sep. 4, 2013

(86) PCT No.: PCT/JP2013/073774
§ 371 (c)(1),
(2) Date: Feb. 11, 2015

(87) PCT Pub. No.: WO2014/038580
PCT Pub. Date: Mar. 13, 2014

(65) Prior Publication Data

US 2015/0222052 A1 Aug. 6, 2015

(30) Foreign Application Priority Data

Sep. 7, 2012 (JP) ..... 2012-197732

(51) Int. Cl.
*H01R 13/73* (2006.01)
*H01R 13/627* (2006.01)
*H01R 13/74* (2006.01)
*H01R 13/639* (2006.01)

(52) U.S. Cl.
CPC ..... *H01R 13/6273* (2013.01); *H01R 13/6395* (2013.01); *H01R 13/743* (2013.01); *H01R 13/6272* (2013.01)

(58) Field of Classification Search
CPC ..... H01R 13/6273; H01R 13/743
USPC ..... 439/563
See application file for complete search history.

(56) References Cited

U.S. PATENT DOCUMENTS 7,575,473 B2 * 8/2009 Kodama ..... H01R 13/6273 439/372
2007/0173089 A1 7/2007 Murakami et al.
2007/0173112 A1 7/2007 Murakami et al.
2008/0248697 A1 10/2008 Whiteman et al.

(Continued)

FOREIGN PATENT DOCUMENTS

CN 101218715 A 7/2008
CN 101282016 A 10/2008

(Continued)

OTHER PUBLICATIONS

International Preliminary Report on Patentability and English language Written Opinion of the International Search Report for PCT/JP2013/073774.

(Continued)

*Primary Examiner* — Tho D Ta
(74) *Attorney, Agent, or Firm* — Kenealy Vaidya LLP

(57) ABSTRACT

A separation prevention rib (85) is formed in a locking protrusion (80), an engagement portion (31) of a locking arm (30) is caught on the separation prevention rib (85) when a second connector housing (60) is separated, and thus a first connector housing (10) is pulled by the separation operation of the second connector housing (60) to re-lock the first connector housing (10) to a panel (P).

3 Claims, 13 Drawing Sheets

(56) References Cited

U.S. PATENT DOCUMENTS

| | | | |
|---|---|---|---|
| 2008/0305672 | A1 | 12/2008 | Kodama et al. |
| 2009/0011632 | A1 | 1/2009 | Ito et al. |
| 2009/0209124 | A1 | 8/2009 | Klein |

FOREIGN PATENT DOCUMENTS

| | | | |
|---|---|---|---|
| JP | 2005-259553 | A | 9/2005 |
| JP | 2005-259554 | A | 9/2005 |
| JP | 2007-157503 | A | 6/2007 |
| JP | 2007-157658 | A | 6/2007 |
| JP | 2008-305695 | A | 12/2008 |
| JP | 2009-16198 | A | 1/2009 |
| JP | 2010-102872 | A | 5/2010 |

OTHER PUBLICATIONS

International Search Report and Written Opinion of the International Search Report for PCT/JP2013/073774 dated Nov. 5, 2013.
Office Action from Chinese Patent App. No. 201380046900.3 (Apr. 6, 2016).

* cited by examiner

PANEL-FIXED CONNECTOR DEVICE

TECHNICAL FIELD

The present invention relates to a panel fixing type connector device in which a first connector housing and a second connector housing are fitted to each other with a panel interposed therebetween.

BACKGROUND ART

FIG. 13 illustrates the configuration of a type of connector device of the related art described in PTL 1. The connector device includes a first connector housing 110 which is mounted in a mounting hole Pa of a panel P from one side in a direction perpendicular to the panel P, and a second connector housing 160 which is fitted to the first connector housing 110 with the panel P interposed therebetween through the mounting hole Pa from the other side in the direction perpendicular to the panel P.

In the connector housings 110 and 160, terminal metal fittings (not illustrated) which are electrically connected to each other when the two connector housings 110 and 160 are fitted to each other are respectively accommodated. A first connector is constituted by the first connector housing 110 and the terminal metal fittings accommodated in the first connector housing 110. In addition, a second connector is constituted by the second connector housing 160 and the terminal metal fittings accommodated in the second connector housing 160.

The first connector housing 110 is provided with temporary locking arms 112. The temporary locking arms 112 include locking protrusions 113. When the first connector housing 110 is inserted into the mounting hole Pa of the panel P from the one side, the temporary locking arm 112 is bent inward from the initial positions by coming into sliding contact with the peripheral edge of the mounting hole Pa. In addition, when the first connector housing 110 is further inserted to a predetermined position, the temporary locking locking arm 112 returns to the initial position from the bent position such that the locking protrusion 113 is locked to the peripheral edge of the mounting hole Pa. Accordingly, the temporary locking arm 112 temporarily locks the first connector housing 110 to the mounting hole Pa of the panel P in a state of impeding the movement of the first connector housing 110 toward the one side.

The second connector housing 160 is provided with complete fixing portions 170 which are locked to the peripheral edge of the mounting hole Pa of the panel P to allow the second connector housing 160 to be completely fixed to the panel P. In addition, the second connector housing 160 is provided with temporary locking releasing portions 180, which, when the second connector housing 160 is fitted to the first connector housing 110 in the state where the locking protrusions 113 of the temporary locking arms 112 are locked to the mounting hole Pa of the panel P, allow the temporary locking arm 112 to be bent inward during the fitting operation and thus release the locking of the temporary locking arms 112 to the mounting hole Pa of the panel P.

In addition, main locking portions 190 which allow the first connector housing 110 and the second connector housing 160 to be locked to each other when the first connector housing 110 and the second connector housing 160 are completely fitted to each other are provided between the first connector housing 110 and the second connector housing 160.

The main locking portions 190 include locking arms 191 provided in the first connector housing 110 and stepped portions 192 provided in the second connector housing 160. The stepped portion 192 is provided by concavely forming an inclined surface which is increased in height moving toward the rear side, and the rear end portion thereof serves as a locking portion. The tip end of the locking arm 191 is provided with a lower surface engagement protrusion 191*a* and an upper surface engagement protrusion 191*b*.

When the second connector housing 160 is fitted to the first connector housing 110, part-way during the fitting, the lower surface engagement protrusion 191*a* of the locking arm 191 and the stepped portion 192 interfere with each other. Due to the interference, the locking arm 191 is bent outward from the initial position. In addition, when the fitting further proceeds and then a completely fitted state is achieved, the locking arm 191 returns to the initial position from the bent position. Accordingly, the lower surface engagement protrusion 191*a* of the locking arm 191 is engaged with the rear end portion of the stepped portion 192 such that the first connector housing 110 and the second connector housing 160 are locked to each other.

When the second connector housing 160 is fitted to the first connector housing 110 in a state where the tip end of the locking arm 191 is inserted into the mounting hole Pa of the panel P and the lower surface engagement protrusion 191*a* of the locking arm 191 and the stepped portion 192 interfere with each other part-way during the fitting so as to cause the locking arm 191 to be bent outward, the upper surface engagement protrusion 191*b* of the locking arm 191 interferes with panel P such that the locking arm 191 and the stepped portion 192 restrict the movement of the first connector housing 110 relative to the panel P until the first connector housing 110 and the second connector housing 160 are completely fitted to each other. In addition, in a state where the first connector housing 110 and the second connector housing 160 are completely fitted to each other, the upper surface engagement protrusion 191*b* of the locking arm 191 which returns to the initial position from the bent position comes away from the position that interferes with the panel P such that the locking arm 191 and the stepped portion 192 also function as movement restricting and allowing portions 195 which allow the movement of the first connector housing 110 relative to the panel P.

In a case of using the connector device, first, the first connector housing 110 is mounted in the mounting hole Pa of the panel P from the one side in the direction perpendicular to the panel P. At this time, as the tip end of the temporary locking arm 112 is inserted into the mounting hole Pa, the locking protrusion 113 of the temporary locking arm 112 comes into sliding contact with the peripheral edge of the mounting hole Pa such that the temporary locking arm 112 is bent inward. When the tip end of the temporary locking arm 112 is further inserted to a predetermined position, the temporary locking arm 112 returns to the initial position from the bent position such that the locking protrusion 113 of the temporary locking arm 112 is locked to the peripheral edge of the mounting hole Pa of the panel P. Accordingly, the first connector housing 110 is temporarily locked to the panel P.

Subsequently, the second connector housing 160 is fitted from the opposite side of the panel P to the first connector housing 110 in the state where the locking protrusion 113 of the temporary locking arm 112 is locked to the mounting hole Pa of the panel P. Then, the temporary locking releasing portion 180 allows the temporary locking arm 112 to be bent inward as the fitting operation proceeds such that the locking of the locking protrusion 113 of the temporary locking arm 112 to the mounting hole Pa of the panel P is released.

In addition, during the operation of fitting the second connector housing 160 to the first connector housing 110, the lower surface engagement protrusion 191*a* of the locking arm 191 on the first connector housing, which is included in the main locking portion 190, rides on the stepped portion 192 on the second connector housing 160 side which is the opposite side to the panel P (that is, the second connector housing 160 side). Accordingly, the locking arm 191 is bent outward such that the upper surface engagement protrusion 191*b* of the locking arm 191 is engaged with the peripheral edge of the mounting hole Pa of the panel P. As a result, the first connector housing 110 is restricted so as not to move relative to the panel P. Therefore, the second connector housing 160 can be fitted to the first connector housing 110 in the state of being fixed to the panel P.

When the second connector housing 160 is completely fitted to the first connector housing 110, the lower surface engagement protrusion 191*a* of the locking arm 191 of the main locking portion 190 is placed over the stepped portion 192, the locking arm 191 returns to the initial position from the bent position, and the lower surface engagement protrusion 191*a* is engaged with the rear end portion of the stepped portion 192. Accordingly, the first connector housing 110 and the second connector housing 160 are locked to each other.

In this state, as the locking arm 191 returns to the initial position from the bent position, the upper surface engagement protrusion 191*b* of the locking arm 191 comes away from the position that is engaged with the peripheral edge of the mounting hole Pa of the panel P, and thus the first connector housing 110 can move relative to the panel P. Therefore, by pushing the second connector housing 160 fitted to the first connector housing 110 against the panel P, the complete fixing portion 170 provided in the second connector housing 160 can be locked to the peripheral edge of the mounting hole Pa of the panel P. Accordingly, the second connector housing 160 and the first connector housing 110 can be completely fixed to the panel P.

CITATION LIST

Patent Literature

[PTL 1] JP-A-2005-259553

SUMMARY OF INVENTION

Technical Problem

Here, in the above-described connector device of the related art, it was found that the following points have to be technically examined.

That is, in the connector device of the related art, when the second connector housing 160 is fitted from the opposite side of the panel P to the first connector housing 110 in the state where the locking protrusion 113 of the temporary locking arm 112 is locked to the mounting hole Pa of the panel P, the locking of the temporary locking arm 112 to the peripheral edge of the mounting hole Pa of the panel P is released by the action of the temporary locking releasing portion 180 part-way during the fitting. In a case where the fitting is stopped part-way during the fitting to separate the second connector housing 160 from the first connector housing 110, there is a possibility that the second connector housing 160 may be separated from the first connector housing 110 before the locking protrusion 113 of the temporary locking arm 112 is re-locked to the peripheral edge of the mounting hole Pa. When the second connector housing 160 is separated, the first connector housing 110 may also be separated from the panel P.

The present invention has been made taking the foregoing circumstances into consideration, and an object thereof is to provide a panel fixing type connector device which guarantees that a first connector housing is not separated from a panel even in a case where, part-way during fitting of a second connector housing to the first connector housing which is in a state of being temporarily locked to a mounting hole of the panel in advance, the fitting is stopped for some reason to separate the second connector housing from the first connector housing.

Solution to Problem

The object of the present invention is accomplished by the following configurations.

(1) A panel fixing type connector device including:

a first connector housing which is mounted in a mounting hole of a panel from one side in a direction perpendicular to the panel; and a second connector housing which is fitted to the first connector housing with the panel interposed therebetween through the mounting hole from the other side in the direction perpendicular to the panel, in which, the first connector housing is provided with temporary locking arms which are bent inward from initial positions as an outer inclined surface of the arm comes into sliding contact with a peripheral edge of the mounting hole when the first connector housing is inserted into the mounting hole of the panel from the one side, return to the initial positions from the bent positions when the first connector housing is further inserted to a predetermined position so as to allow the locking portion to be locked to the peripheral edge of the mounting hole, and temporarily lock the first connector housing to the mounting hole of the panel in a state of impeding movement of the first connector housing toward the one side, the second connector housing is provided with complete fixing portions which are locked to the peripheral edge of the mounting hole of the panel to completely fix the second connector housing to the panel, and temporary locking releasing portions which, when the second connector housing is fitted to the first connector housing in a state where the temporary locking arm is locked to the mounting hole of the panel, allow the temporary locking arms to be bent inward due to the fitting operation and thus release the locking of the temporary locking arms to the mounting hole of the panel, and the first connector housing and the second connector housing are further provided with, movement restricting and allowing portions which, when the second connector housing is fitted to the first connector housing in a state where the temporary locking arm is locked to the mounting hole of the panel, restrict the movement of the first connector housing relative to the panel until the first connector housing and the second connector housing are completely fitted to each other, and in a state where the first connector housing and the second connector housing are completely fitted to each other, allow the movement of the first connector housing relative to the panel, main locking portions which allow the first connector housing and the second connector housing to be locked to each other when the first connector housing and the second connector housing are completely fitted to each other, and a separation prevention portion which, when the locking of the temporary locking arm to the mounting hole of the panel is released by the temporary locking releasing portion as the second connector housing is fitted to the first connector housing until an intermediate stage in a state where the temporary locking arm is locked to the mounting hole of the panel, and in this state, the fitting of the first connector housing to the second connector housing is stopped to separate the second connector housing from the first connector housing, pulls the first connector housing to a position at which the temporary locking arm in a state where the locking to the mounting hole of the panel is released is re-locked to the mounting hole of the panel due to the separation operation of the second connector housing so as to allow the temporary locking arm to be re-locked to the mounting hole of the panel, and thus impedes the separation of the first connector housing from the panel.

(2) The panel fixing type connector device described in (1), in which the main locking portions include a locking arm provided in the first connector housing and a locking protrusion provided in the second connector housing, when the second connector housing is fitted to the first connector housing, part-way during the fitting operation, the locking arm and the locking protrusion interfere with each other such that the locking arm is bent outward from an initial position, when the fitting operation further proceeds and then a completely fitted state is achieved, the locking arm returns to the initial position from the bent position such that an engagement portion provided in the locking arm is engaged with the locking protrusion and accordingly the first connector housing and the second connector housing are locked to each other, when the second connector housing is fitted to the first connector housing in a state where the engagement portion of the locking arm is inserted into the mounting hole of the panel and the locking arm and the locking protrusion interfere with each other part-way during the fitting operation so as to cause the locking arm to be bent outward, the engagement portion of the locking arm interferes with the panel such that the locking arm and the locking protrusion restrict the movement of the first connector housing relative to the panel until the first connector housing and the second connector housing are completely fitted to each other, in a state where the first connector housing and the second connector housing are completely fitted to each other, the engagement portion of the locking arm which returns to the initial position from the bent position comes away from a position that interferes with the panel such that the locking arm and the locking protrusion also function as the movement restricting and allowing portions which allow the movement of the first connector housing relative to the panel, and the locking protrusion is further provided with, as a separation prevention portion, a separation prevention rib protruding therefrom, which, when the locking of the temporary locking arm to the mounting hole of the panel is released by the temporary locking releasing portion as the second connector housing is fitted to the first connector housing until an intermediate stage in the state where the locking protrusion is locked to the mounting hole of the panel, and in this state, the fitting of the second connector housing to the first connector housing is stopped to separate the second connector housing from the first connector housing, is engaged with the engagement portion of the locking arm which is bent outward, and thus pulls the first connector housing to a position at which the temporary locking arm in a state where the locking to the mounting hole of the panel is released is re-locked to the mounting hole of the panel due to the separation operation of the second connector housing.

According to the connector device having the configuration of (1), when the locking of the temporary locking arm to the mounting hole of the panel is released by the temporary locking releasing portion as the second connector housing is fitted to the first connector housing until an intermediate stage in the state where the temporary locking arm is locked to the mounting hole of the panel, and in this state, the fitting of the first connector housing to the second connector housing is stopped to separate the second connector housing from the first connector housing, the first connector housing can by pulled by the action of the separation prevention portion to the position at which the temporary locking arm in the state where the locking to the mounting hole of the panel is released is re-locked to the mounting hole of the panel due to the separation operation of the second connector housing. Therefore, the temporary locking arm can be re-locked to the mounting hole of the panel by the pulling operation, and thus the separation of the first connector housing from the panel can be impeded.

According to the connector device having the configuration of (2), since the separation prevention rib as the separation prevention portion is provided in the locking protrusion which is engaged with the locking arm, when the fitting operation is stopped part-way during the operation of fitting the second connector housing to the first connector housing to separate the second connector housing from the first connector housing, the engagement portion of the locking arm which is bent outward and the separation prevention rib are engaged with each other such that the first connector housing can be pulled by the separation operation of the second connector housing. Accordingly, the temporary locking arm in the locking-released state can be re-locked to the mounting hole of the panel, and thus the separation of the first connector housing from the panel can be prevented.

According to the present invention, it can be guaranteed that the first connector housing is not separated from the panel even in a case where, part-way during the operation of fitting the second connector housing to the first connector housing which is in a state of being temporarily locked to the mounting hole of the panel in advance, the fitting operation is stopped for some reason to separate the second connector housing from the first connector housing.

Hereinabove, the present invention is briefly described. Furthermore, the details of the present invention will be further clarified by reading through the modes for embodying the present invention (hereinafter, referred to as embodiments) described below with reference to the accompanying drawings.

DESCRIPTION OF EMBODIMENTS

Hereinafter, an embodiment of the present invention will be described with reference to the drawings.

Figure 1:
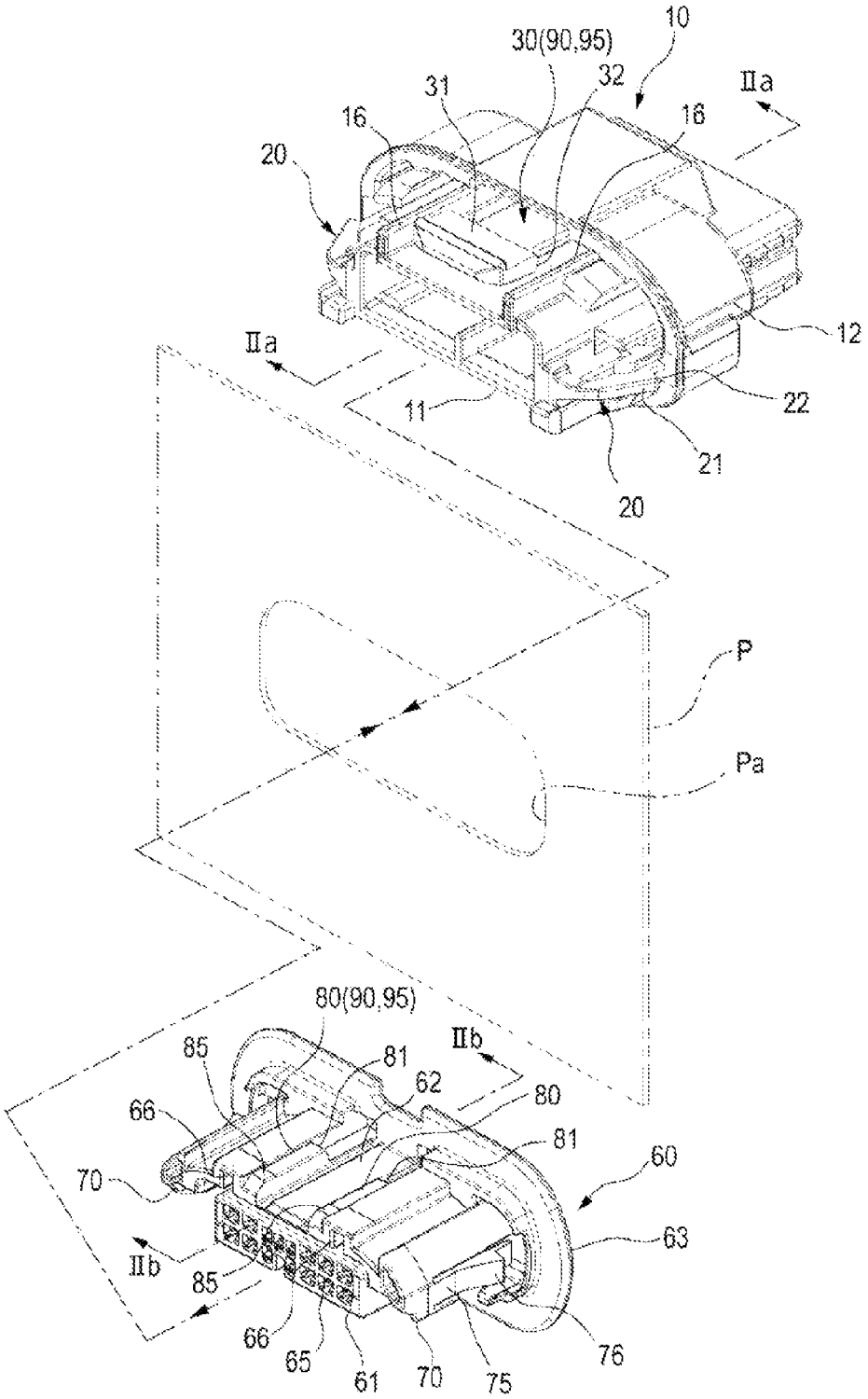
FIG. 1 is a perspective view illustrating a state before mounting a connector device of an embodiment of the present invention.
Figure 2:
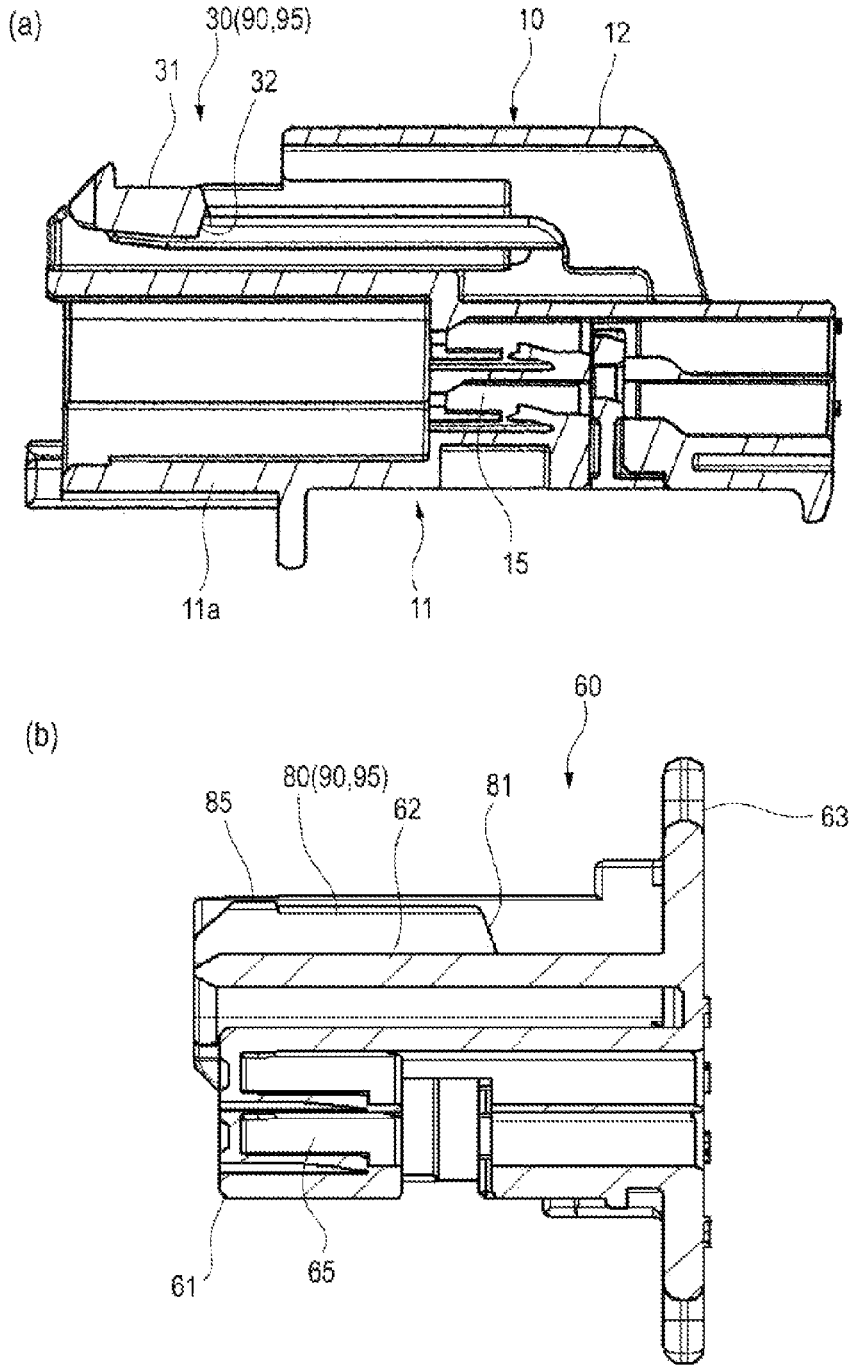
FIG. 2(*a*) is a cross-sectional view illustrating the configuration of a first connector housing 10 taken along line IIa-IIa of FIG. 1, and FIG. 2(*b*) is a cross-sectional view illustrating the configuration of a second connector housing 60 taken along line IIb-IIb of FIG. 1.
Figure 3:
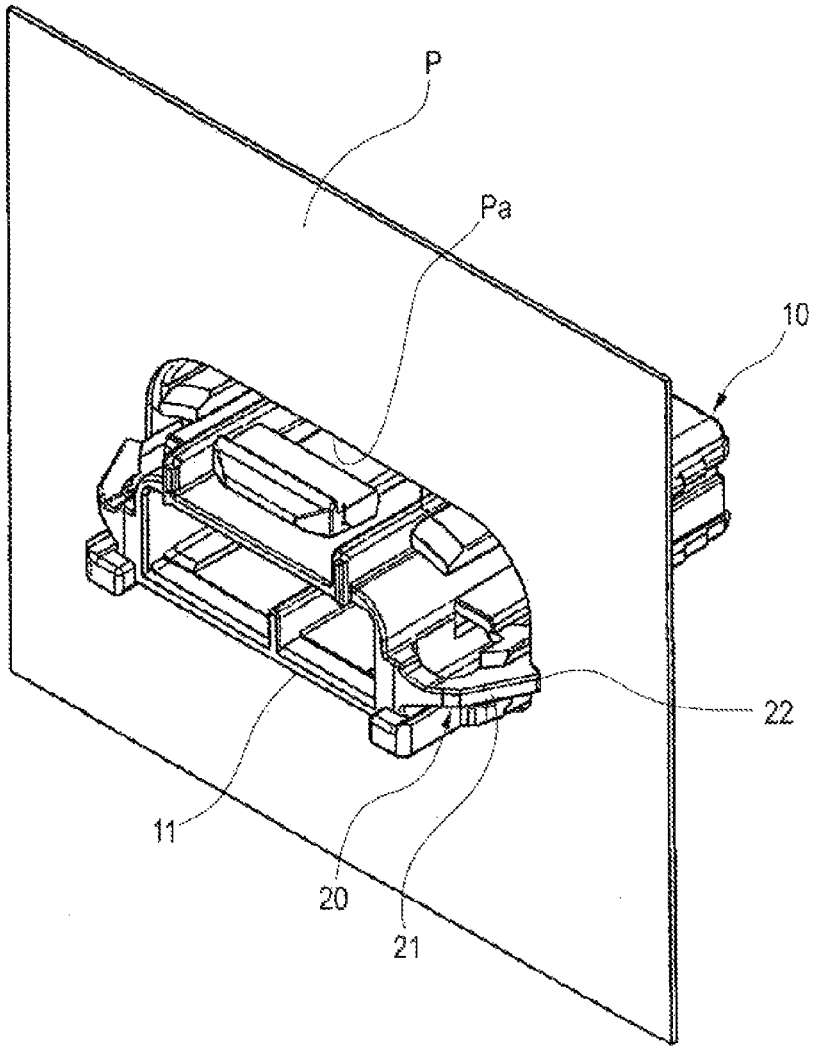
FIG. 3 is a perspective view illustrating a state where temporary locking arms 20 of the first connector housing 10 are temporarily locked to a mounting hole Pa of a panel P.
Figure 4:
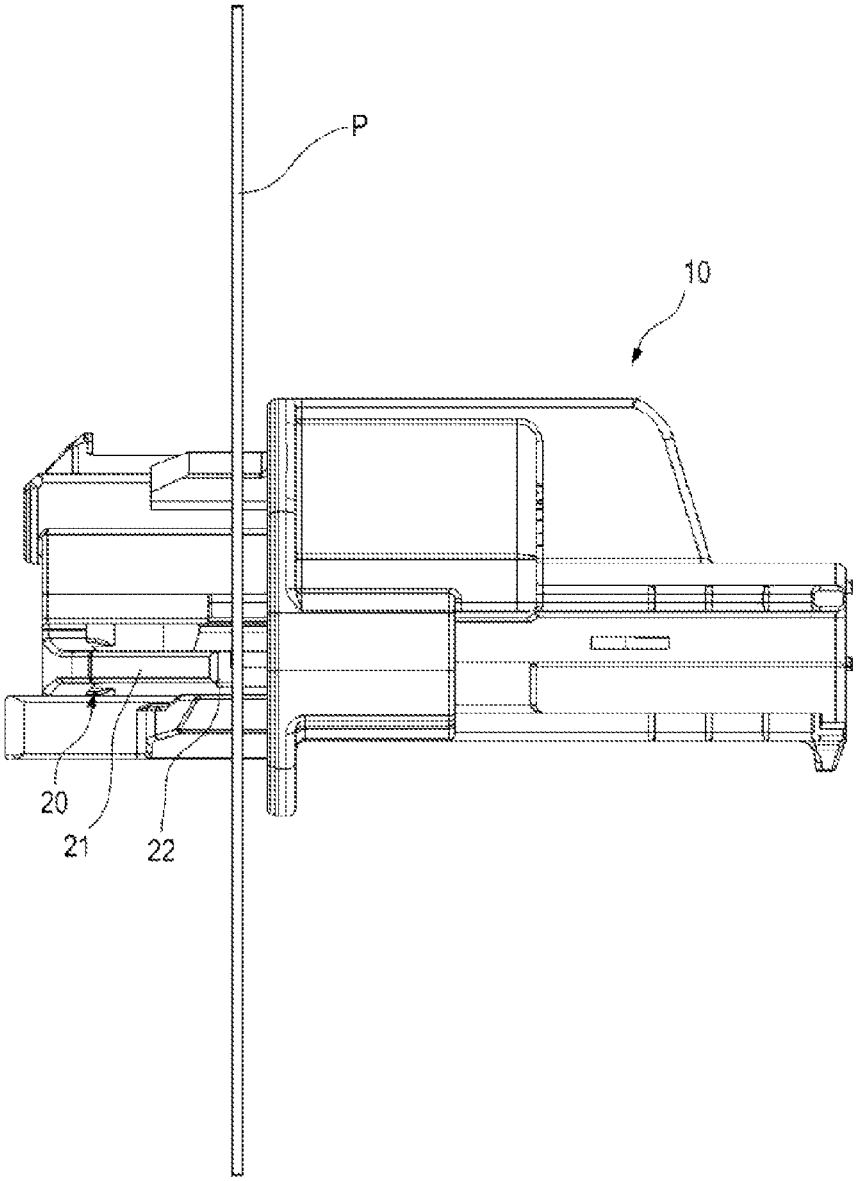
FIG. 4 is a side view illustrating the same state as that of FIG. 3.

FIG. 1 is a perspective view illustrating a state before mounting a connector device of the embodiment, FIG. 2(*a*) is a cross-sectional view taken along line IIa-IIa of FIG. 1, FIG. 2(*b*) is a cross-sectional view taken along line IIb-IIb of FIG. 1, FIG. 3 is a perspective view illustrating a state where a first connector housing is temporarily locked to a mounting hole of a panel, and FIG. 4 is a side view thereof.

As illustrated in FIG. 1, a panel fixing type connector device of the embodiment includes a first connector housing 10 which is mounted in a mounting hole Pa of a panel P from one side in a direction perpendicular to the panel P, and a second connector housing 60 which is fitted to the first connector housing 10 with the panel P interposed between the first connector housing 10 and the second connector housing 60 through the mounting hole Pa from the other side in the direction perpendicular to the panel P.

In the connector housings 10 and 60, terminal metal fittings (not illustrated) which are electrically connected to each other when the two connector housings 10 and 60 are fitted to each other are respectively accommodated. A first connector is constituted by the first connector housing 10 and the terminal metal fittings accommodated in the first connector housing 10. In addition, second connector is constituted by the second connector housing 60 and the terminal metal fittings accommodated in the second connector housing 60. In the descriptions of the connector housings 10 and 60, a front side indicates a forward side which is fitted to the opposite connector housing, and a rear side indicates the opposite side thereto. In addition, an upper side and a lower side respectively indicate the upper side and the lower side illustrated in FIG. 1.

As illustrated in FIG. 2(*a*), the first connector housing 10 includes a connector body portion 11 in which a cylindrical fitting portion 11*a* is formed in the front half and a terminal accommodation chamber 15 is formed in the rear half. In addition, the first connector housing 10 includes an upper cover portion 12 which is provided to cover the upper side of the axially intermediate portion of the connector body portion 11. In the first connector housing 10, male terminal metal fittings (not illustrated) are accommodated in the terminal accommodation chamber 15 of the connector body portion 11, and the tip end of each of the male terminal metal fittings protrudes from the inner portion of the cylindrical fitting portion 11*a*.

As illustrated in FIGS. 1 and 3, temporary locking arms 20 are respectively provided on the right and left sides of the first connector housing 10. When the first connector housing 10 is inserted into the mounting hole Pa of the panel P from the one side, an outer inclined surface 21 of the temporary locking arm 20 comes into sliding contact with the peripheral edge of the mounting hole Pa of the panel P such that the temporary locking arm 20 is bent inward from the initial position. The temporary locking arm 20 returns to the initial position from the bent position when the first connector housing 10 is further inserted to a predetermined position such that a locking stepped portion 22 is locked to the peripheral edge of the mounting hole Pa. Accordingly, the temporary locking arm 20 temporarily locks the first connector housing 10 to the mounting hole Pa of the panel P in a state of impeding the movement of the first connector housing 10 toward the one side.

The temporary locking arm 20 is formed in a cantilevered shape such that the front end portion is fixed to the side portion of the connector body portion 11 and the free end extends rearward. In the temporary locking arm 20, the outer inclined surface 21 which is inclined to protrude outward moving from the front side to the rear side is formed on the arm outer surface positioned on the front side of the locking stepped portion 22.

As illustrated in FIGS. 1 and 2(*b*), the second connector housing 60 includes a prismatic connector body portion 61 which fits in the inner portion of the cylindrical fitting portion of the connector body portion 11 of the first connector housing 10. In addition, the second connector housing 60 includes an upper cover wall 62 which is provided on the upper side of the connector body portion 61 with an interval therebetween, and a flange 63 which is provided at the rear ends of the connector body portion 61 and the upper cover wall 62. Female terminal metal fittings (not illustrated) are accommodated in a terminal accommodation chamber 65 of the connector body portion 61. When the connector body portion 61 of the second connector housing 60 is fitted into the cylindrical fitting portion 11*a* of the connector body portion 11 of the first connector housing 10, the male terminal metal fittings accommodated in the first connector housing 10 and the female terminal metal fittings accommodated in the second connector housing 60 are electrically connected to each other.

As illustrated in FIG. 1, sliding grooves 66 in which ribs 16 formed on the upper surface of the connector body portion 11 of the first connector housing 10 are respectively fitted are provided on the lower surface of the upper cover wall 62 of the second connector housing 60. As the ribs 16 are fitted in the sliding grooves 66, the fitting operation of the first connector housing 10 and the second connector housing 60 is guided.

In addition, in the right and left side portions of the upper cover wall 62 of the second connector housing 60, complete fixing arms (that is, body fixing portions) 75 which are locked to the peripheral edge of the mounting hole Pa when inserted into the mounting hole Pa of the panel P to completely fix the second connector housing 60 to the panel P are provided. The complete fixing arms 75 are provided with locking protrusions 76 which allow the panel P to be interposed between the locking protrusions 76 and the flange 63 without backlash.

At positions of the right and left side portions of the upper cover wall 62 of the second connector housing 60 which correspond to the temporary locking arms 20 on the first connector housing 10 side, temporary locking releasing portions 70 are provided which, when the second connector housing 60 is fitted to the first connector housing 10 in the state where the locking stepped portions 22 of the temporary locking arms 20 are locked to the peripheral edge of the mounting hole Pa of the panel P, allowing the temporary locking arms 20 to be bent inward during the fitting operation and thus release the locking of the locking stepped portions 22 of the temporary locking arms 20 to the peripheral edge of the mounting hole Pa of the panel P. The temporary locking releasing portion 70 allows the temporary locking arm 20 to be bent inward by sliding on the outer inclined surface 21 of the temporary locking arm 20 when the second connector housing 60 is initially fitted to the first connector housing 10.

Main locking portions 90 which allow the first connector housing 10 and the second connector housing 60 to be locked to each other when the first connector housing 10 and the second connector housing 60 are completely fitted to each other are provided between the first connector housing 10 and the second connector housing 60.

The main locking portions 90 include locking arm 30 provided in the first connector housing 10 and locking protrusions 80 provided in the second connector housing 60.

The locking arm 30 is provided between the upper surface of the connector body portion 11 of the first connector housing 10 and the upper cover portion 12, and is formed in a cantilevered shape such that the rear end is fixed to the connector body portion 11 and the free end which extends forward. The front end (that is, the free end) of the locking arm 30 is provided with an engagement portion 31 which laterally protrudes from the width of the base end side of the locking arm 30, and the rear end surface of the engagement portion 31 serves as an engagement wall 32.

The locking protrusion 80 is provided on the upper surface of the upper cover wall 62 of the second connector housing 60 to correspond to the position of the engagement portion 31 which laterally protrudes from the front end of the locking arm 30. The rear end surface of the locking protrusion 80 serves as an engagement wall 81 which is engaged with the engagement wall 32 of the rear end surface of the engagement portion 31 of the locking arm 30.

When the second connector housing 60 is fitted to the first connector housing 10, the engagement portion 31 of the locking arm 30 and the locking protrusion 80 interfere with each other part-way during the fitting operation. The locking arm 30 is bent outward (upward in FIG. 7) from the initial position due to the interference. In addition, when the fitting operation further proceeds and then a completely fitted state is achieved, the locking arm 30 returns to the initial position from the bent position. Accordingly, the engagement wall 32 of the engagement portion 31 of the locking arm 30 is engaged with the engagement wall 81 of the locking protrusion 80 such that the first connector housing 10 and the second connector housing 60 are locked to each other.

When the second connector housing 60 is fitted to the first connector housing 10 in a state where the temporary locking arm 20 is locked to the mounting hole Pa of the panel P, the locking arm 30 and the locking protrusion 80 restrict the movement of the first connector housing 10 relative to the panel P until the first connector housing 10 and the second connector housing 60 are completely fitted to each other. In a state where the first connector housing 10 and the second connector housing 60 are completely fitted to each other, the locking arm 30 and the locking protrusion 80 also function as movement restricting and allowing portions 95 which allow the movement of the first connector housing 10 relative to the panel P.

That is, when the second connector housing 60 is fitted to the first connector housing 10 in a state where the tip end of the locking arm 30 is inserted into the mounting hole Pa of the panel P and the engagement portion 31 of the locking arm 30 and the locking protrusion 80 interfere with each other part-way during the fitting operation so as to cause the locking arm 30 to be bent outward, the engagement portion 31 of the locking arm 30 interferes with panel P (see FIG. 7) such that the locking arm 30 and the locking protrusion 80 restrict the movement of the first connector housing 10 relative to the panel P until the first connector housing 10 and the second connector housing 60 are completely fitted to each other. In addition, in a state where the first connector housing 10 and the second connector housing 60 are completely fitted to each other, the engagement portion 31 of the locking arm 30 which returns to the initial position from the bent position comes away from the position that interferes with the panel P such that the locking arm 30 and the locking protrusion 80 also function as the movement restricting and allowing portions 95 which allow the movement of the first connector housing 10 relative to the panel P.

A separation prevention rib 85 protrudes from the upper surface of the locking protrusion 80 of the second connector housing 60. When the locking of the temporary locking arm 20 to the mounting hole Pa of the panel P is released by the temporary locking releasing portion 70 as the second connector housing 60 is fitted to the first connector housing 10 until an intermediate stage in the state where the locking arm 30 is locked to the mounting hole Pa of the panel P, and in this state, the fitting of the second connector housing 60 to the first connector housing 10 is stopped to separate the second connector housing 60 from the first connector housing 10, the separation prevention rib 85 is engaged with the engagement portion 31 of the locking arm 30 which is bent outward. The separation prevention rib 85 pulls the first connector housing 10 to the position at which the temporary locking arm 20 in a state where the locking to the mounting hole Pa of the panel P is released is re-locked to the mounting hole Pa of the panel P, due the separation operation of the second connector housing 60. That is, the separation prevention rib 85 functions as a separation prevention portion.

Next, actions will be described.

In a case of using the connector device, first, the first connector housing 10 is mounted in the mounting hole Pa of the panel P from the one side in the direction perpendicular to the panel P. At this time, as the tip end of the temporary locking arm 20 is inserted into the mounting hole Pa, the outer inclined surface 21 of the temporary locking arm 20 comes into sliding contact with the peripheral edge of the mounting hole such that the temporary locking arm 20 is bent inward. When the temporary locking arm 20 is further inserted to a predetermined position, as illustrated in FIGS. 3 and 4, the temporary locking arm 20 returns to the initial position from the bent position such that the locking stepped portions 22 of the temporary locking arms 20 is locked to the peripheral edge of the mounting hole Pa of the panel P. Accordingly, the first connector housing 10 is temporarily locked to the panel P.

Figure 5:
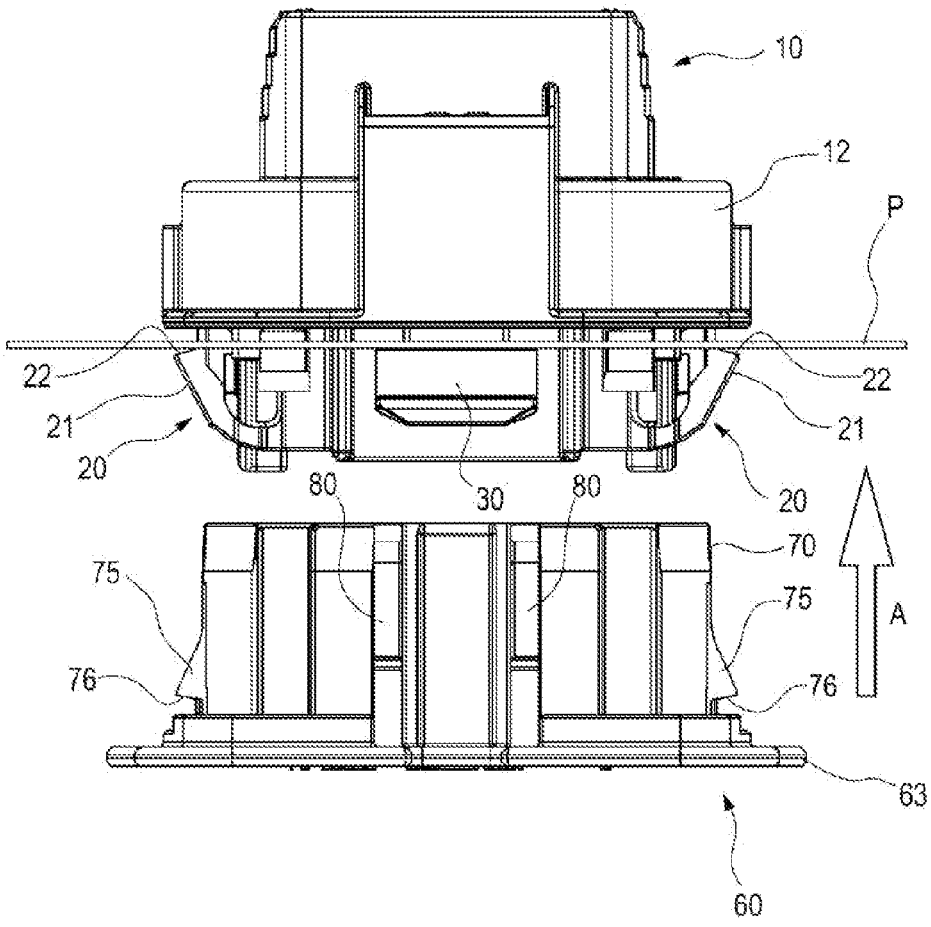
FIG. 5 is a plan view illustrating a state before a fitting operation when the second connector housing 50 is fitted to the first connector housing 10 which is temporarily locked to the mounting hole of the panel.
Figure 6:
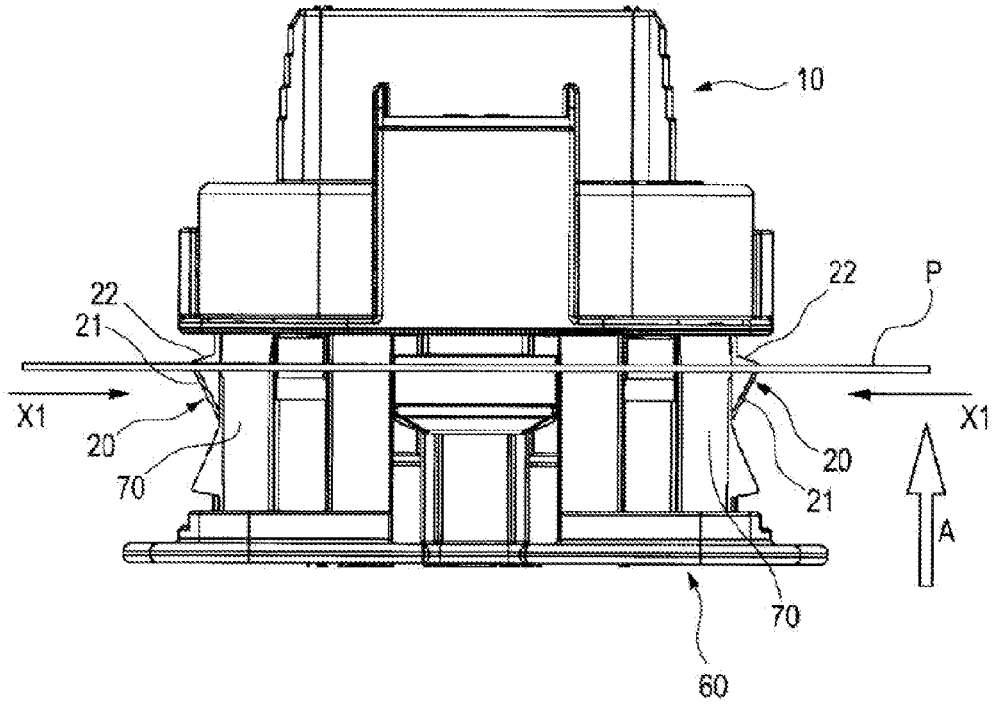
FIG. 6 is a plan view illustrating a state of an intermediate stage in the fitting operation when the second connector housing 20 is fitted to the first connector housing 10 as a subsequent stage of FIG. 5.

Subsequently, as illustrated in FIG. 5, the second connector housing 60 is fitted from the other side of the panel P to the first connector housing 10 in the state where the locking stepped portion 22 of the temporary locking arm 20 is locked to the mounting hole Pa of the panel P (movement indicated by arrow A in FIG. 5). Then, the temporary locking releasing portions 70 allows the temporary locking arms 20 to be bent inward (in the direction indicated by arrow X1 in FIG. 6) part-way during the fitting operation as the fitting operation proceeds as illustrated in FIG. 6 such that the locking of the locking stepped portion 22 of the temporary locking arms 20 to the mounting hole Pa of the panel P is released. In this stage, the locking stepped portions 22 of the temporary locking arms 20 is pushed back from the position that opposes the peripheral edge of the mounting hole Pa of the panel P toward the one side such that the outer inclined surface 21 of the temporary locking arm 20 opposes the peripheral edge of the mounting hole Pa of the panel P.

Figure 7:
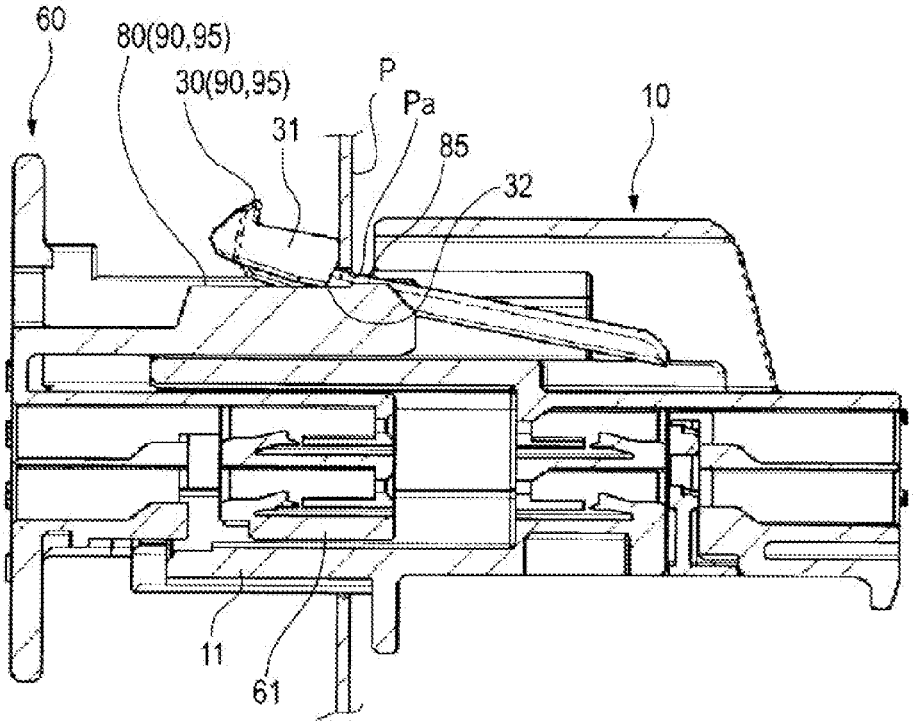
FIG. 7 is a side sectional view illustrating the state of the intermediate stage in the fitting operation of FIG. 6.

In addition, as illustrated in FIG. 7, during the operation of fitting the second connector housing 60 to the first connector housing 10, the engagement portion 31 of the locking arm 30 on the first connector housing 10 side, which is included in the main locking portion 90, rides on the locking protrusion 80 on the second connector housing 60 side which is the opposite side to the panel P (that is, the second connector housing 60 side). Accordingly, the locking arm 30 is bent outward (that is, the upper side in FIG. 7) such that the engagement portion 31 of the locking arm 30 is engaged with the mounting hole Pa of the panel P. As a result, the first connector housing 10 is restricted so as not to move relative to the panel P. Therefore, the second connector housing 60 can be fitted to the first connector housing 10 in the state of being fixed to the panel P.

In addition, when the second connector housing 60 is completely fitted to the first connector housing 10, the engagement portion 31 of the locking arm 30 of the main locking portion 90 is placed over the locking protrusion 80 and the locking arm 30 returns to the initial position from the bent position such that the engagement wall 32 of the engagement portion 31 is engaged with the engagement wall 81 of the locking protrusion 80. Accordingly, the first connector housing 10 and the second connector housing 60 are locked to each other so as not to be separated from each other.

In this state, as the locking arm 30 returns to the initial position from the bent position, the engagement portion 31 of the locking arm 30 comes away from the position that is engaged with the peripheral edge of the mounting hole Pa of the panel P, and thus the first connector housing 10 can move relative to the panel P. Therefore, by pushing the second connector housing 60 fitted to the first connector housing 10 against the panel P, the locking protrusions 76 of the complete fixing arms 75 provided in the second connector housing 60 can be locked to the peripheral edge of the mounting hole Pa of the panel P. Accordingly, the second connector housing 60 and the first connector housing 10 can be completely fixed to the panel P.

Figure 8:
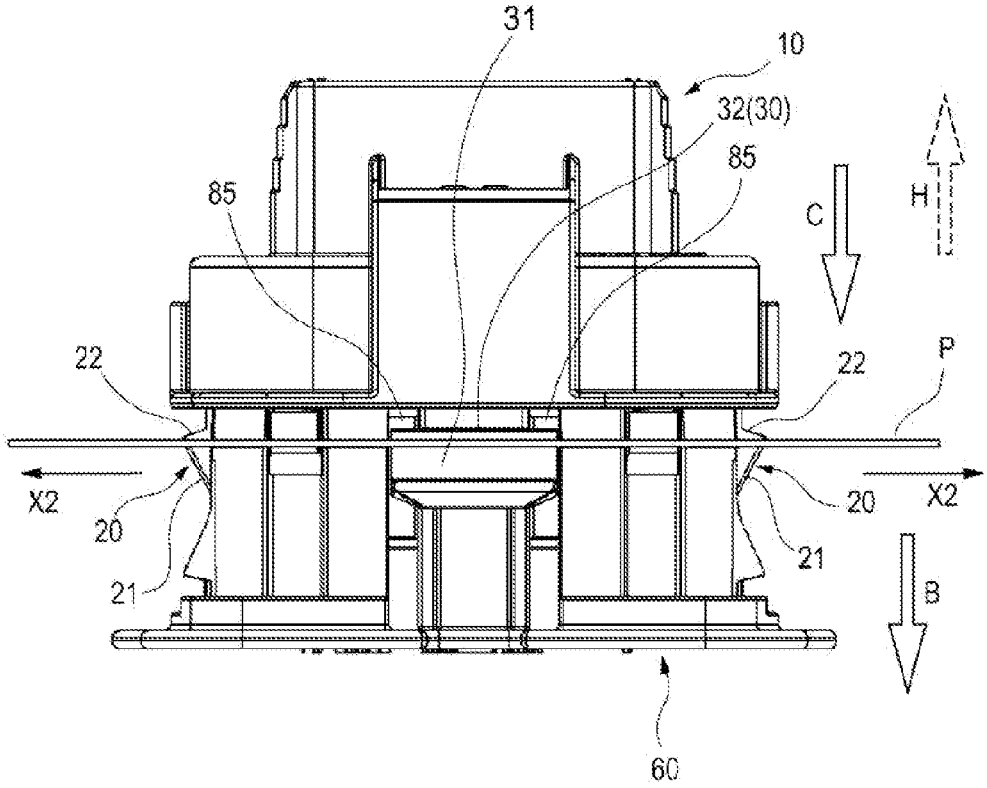
FIG. 8 is a plan view illustrating a state where the fitting operation is stopped from the state of the intermediate stage in the fitting operation in FIG. 6 to separate the second connector housing 60 from the first connector housing 10.

However, as illustrated in FIG. 6, in a state where the locking of the temporary locking arm 20 to the mounting hole Pa of the panel P is released by the temporary locking releasing portions 70 as illustrated in FIG. 8 as the second connector housing 60 is fitted to the first connector housing 10 until an intermediate stage in the state where the temporary locking arm 20 is locked to the mounting hole Pa of the panel P, there may be a case where the fitting of the second connector housing 60 to the first connector housing 10 is stopped for some reason and the second connector housing 60 is separated from the first connector housing 10 as indicated by arrow B.

In this case, a slight pulling force is slightly applied to the first connector housing 10 due to friction caused by the separating force of the second connector housing 60. However, as the outer inclined surface 21 of the temporary locking arm 20 of the first connector housing 10 comes into sliding contact with the peripheral edge of the mounting hole Pa of the panel P, a pushing-back force in the opposite direction (the direction indicated by dotted line arrow H in FIG. 8) to the pulling direction (that is, the separation direction of the second connector housing 60) indicated by arrow B is applied to the first connector housing 10 by the elastic restoring force (that is, the restoring force in the direction indicated by arrow X2 in FIG. 8) of the temporary locking arm 20.

Figure 12:
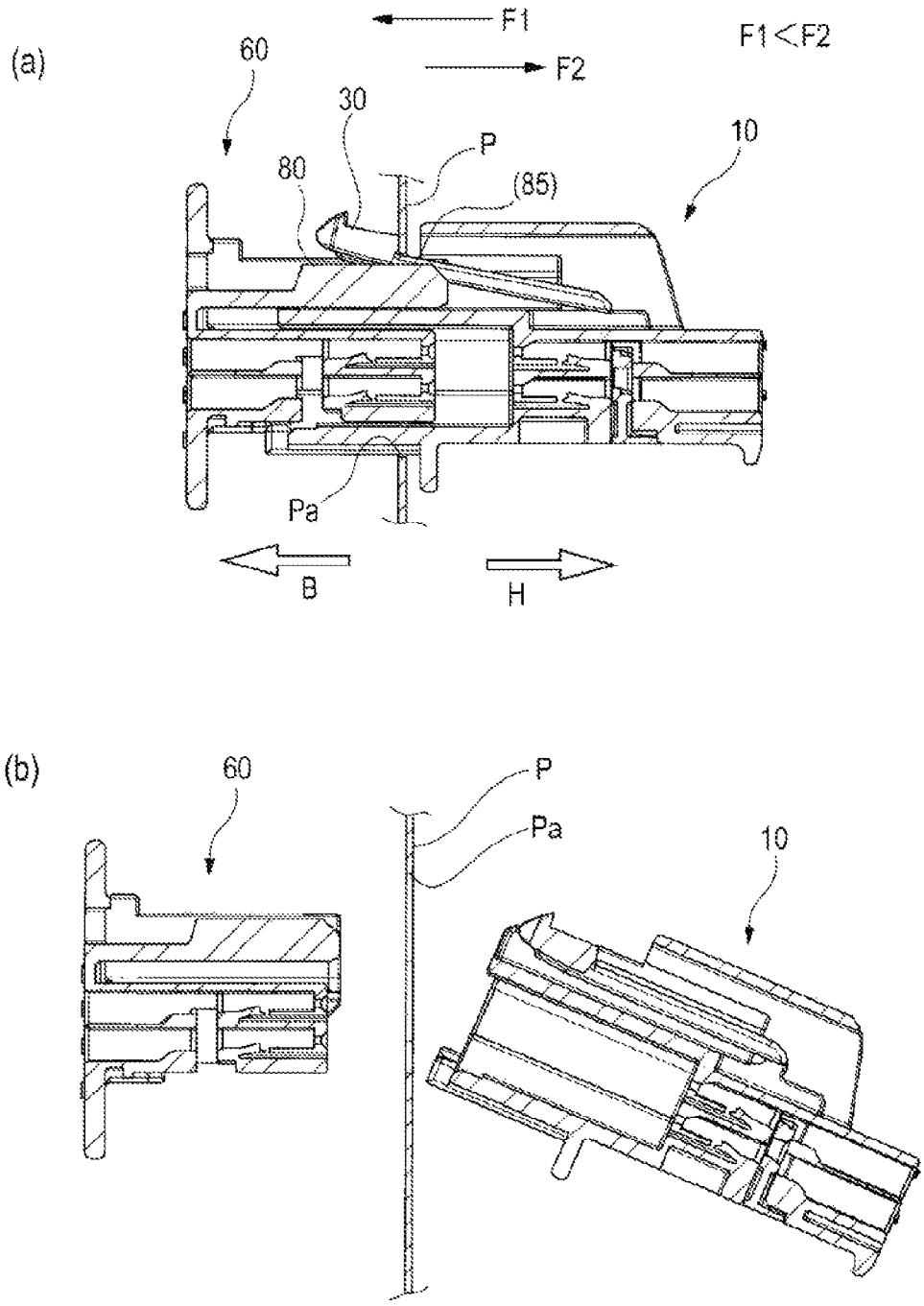
FIGS. 12(*a*) and 12(*b*) are explanatory views of a comparative example to the embodiment of the present invention, in a case where the separation prevention portion (separation prevention rib 82) is not provided, in which FIG. 12(*a*) is a side sectional view illustrating a state where the fitting operation is stopped from the state of an intermediate stage in the fitting operation to separate the second connector housing 60 from the first connector housing 10, and FIG. 12(*b*) is a side sectional view illustrating a state where the temporary locking arm is not re-locked to the mounting hole of the panel at this time, and as a result, the first connector housing 10 is separated from the panel P as the second connector housing 60 is separated from the first connector housing 10.
Figure 13:
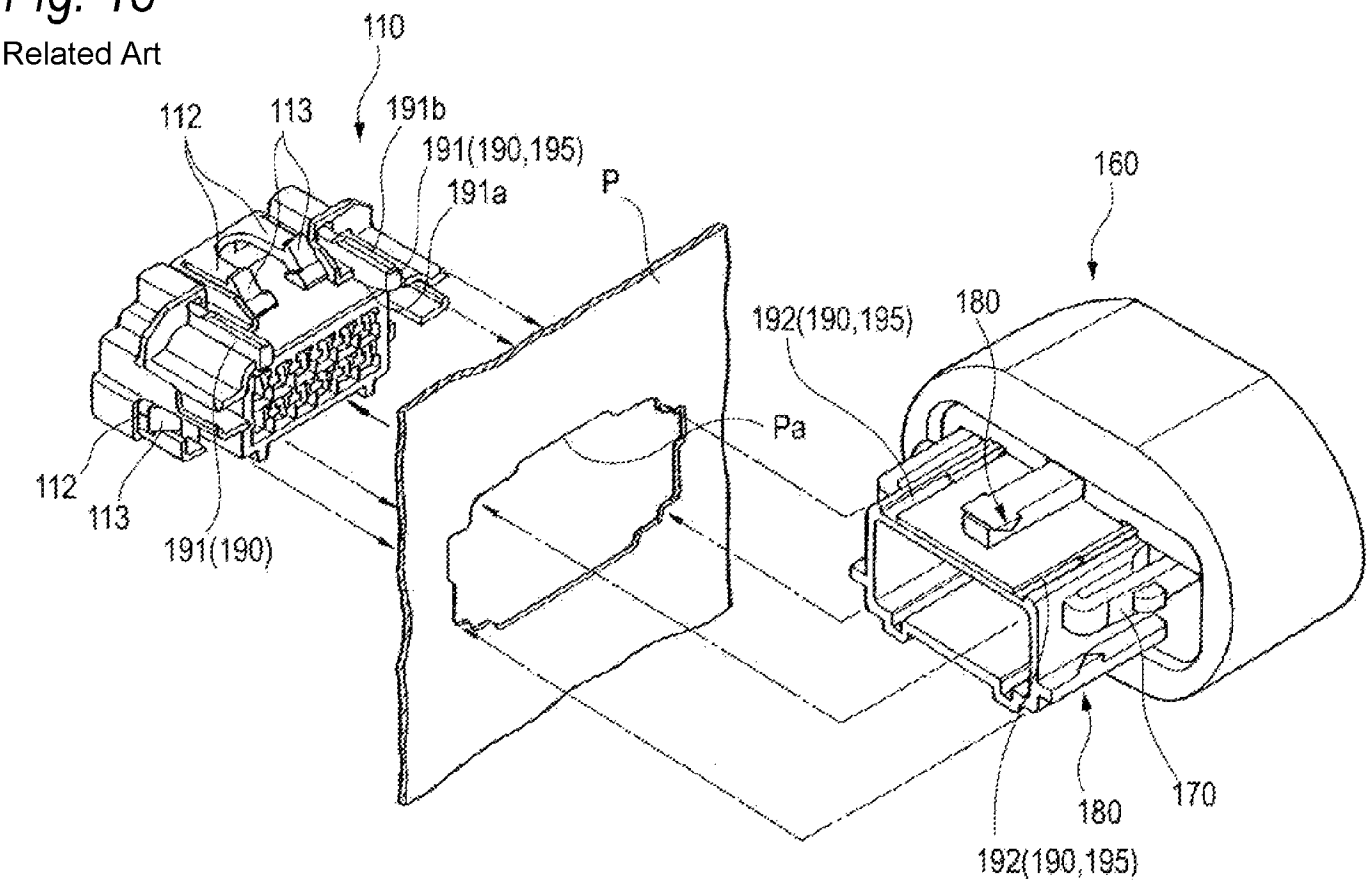
Fig. 13 Related Art
FIG. 13 is a perspective view illustrating the configuration of a type of connector device of the related art described in PTL 1.

FIGS. 12(*a*) and 12(*b*) are explanatory views of a comparative example in which the separation prevention rib 85 is not provided.

As illustrated in FIG. 12(*a*), a pulling force F1 due to the friction caused by the separating force of the second connector housing 60 is applied to the first connector housing 10 in the arrow B direction (that is, the separation direction of the second connector housing 60). At this time, as the outer inclined surface 21 of the temporary locking arm 20 (see FIG. 8) slides on the peripheral edge of the mounting hole Pa of the panel P, a pushing-back force F2 is applied to the first connector housing 10 in the arrow H direction (that is, the opposite direction to the separation direction of the second connector housing 60) by the elastic restoring force of the temporary locking arm 20.

In a case where the pushing-back force F2 is larger than the pulling force F1 (that is, in a case of F1<F2), the first connector housing 10 is pushed back in the arrow H direction. In this case, in a stage in which the first connector housing 10 and the second connector housing 60 are separated from each other, as illustrated in FIG. 12(*b*), the first connector housing 10 is separated from the panel P.

Figure 9:
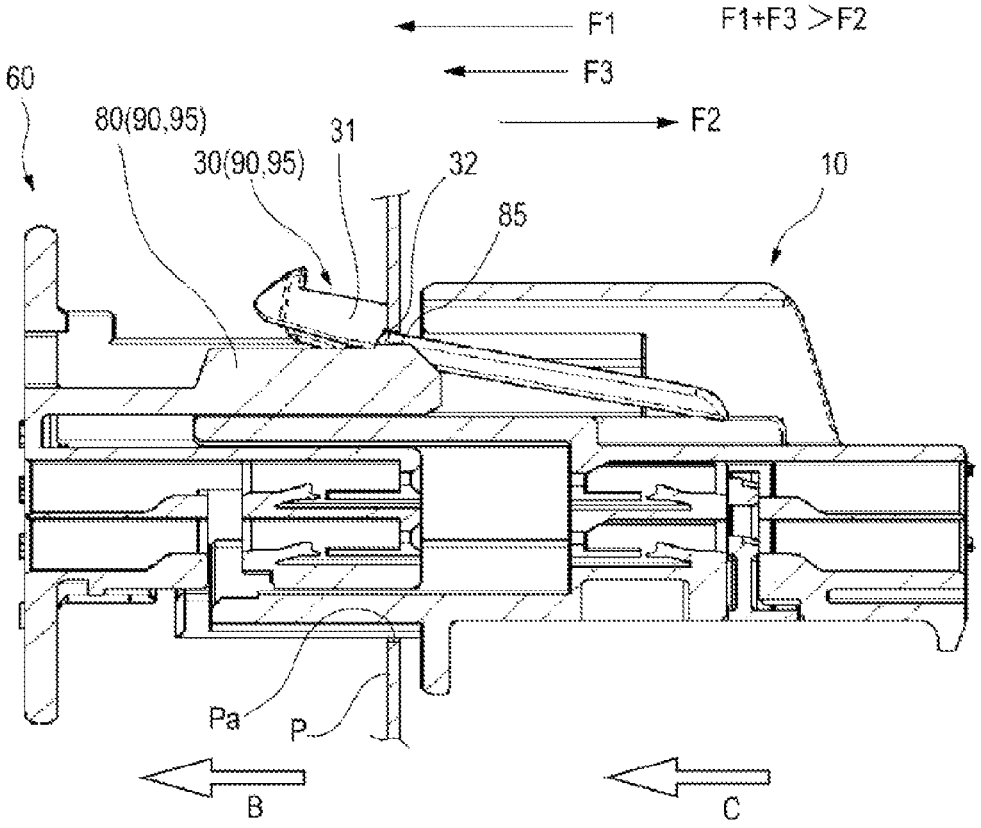
FIG. 9 is a side sectional view illustrating the state of FIG. 8.

In this respect, in the connector device of this embodiment, as illustrated in FIG. 7, the separation prevention rib 85 as the separation prevention portion is provided on the upper surface of the locking protrusion 80 engaged with the locking arm 30. Therefore, as illustrated in FIG. 8, when the fitting operation is stopped part-way during the operation of fitting the second connector housing 60 to the first connector housing 10 to separate the second connector housing 60 from the first connector housing 10, as illustrated in FIG. 9, the engagement portion 31 of the locking arm 30 which is bent outward and the separation prevention rib 85 are engaged with each other such that the first connector housing 10 can be pulled as indicated by arrow C in FIG. 9 by the separation operation of the second connector housing 60.

That is, as the separation prevention rib 85 is caught on the engagement portion 31 of the locking arm 30, a holding force F3 is added in the arrow B direction by the separation prevention rib 85. Therefore, the sum of forces applied to the first connector housing 10 in the arrow B direction becomes larger than the force in the arrow H direction (that is, F1+F3>F2). Accordingly, the first connector housing 10 can be pulled as indicated by arrow C in the same direction as the arrow B direction.

Figure 10:
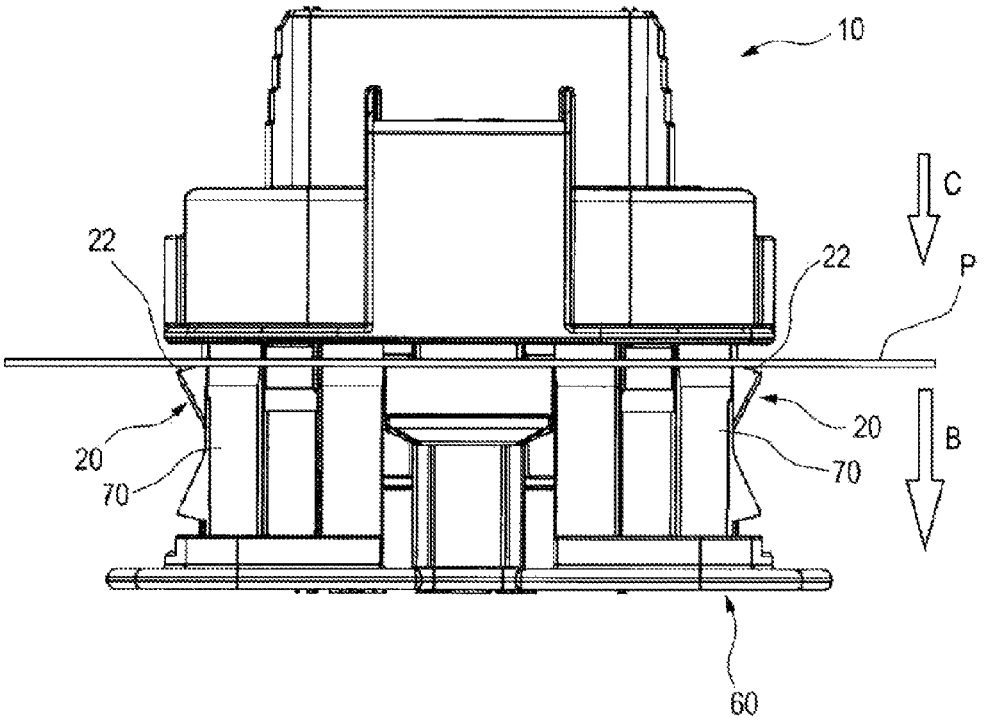
FIG. 10 is a plan view illustrating a state where the first connector housing 10 is pulled by the action of a separation prevention portion (separation prevention rib 82) due to the separation operation of the second connector housing 60, and as a result, the temporary locking arm 20 is re-locked to the peripheral edge of the mounting hole of the panel P.
Figure 11:
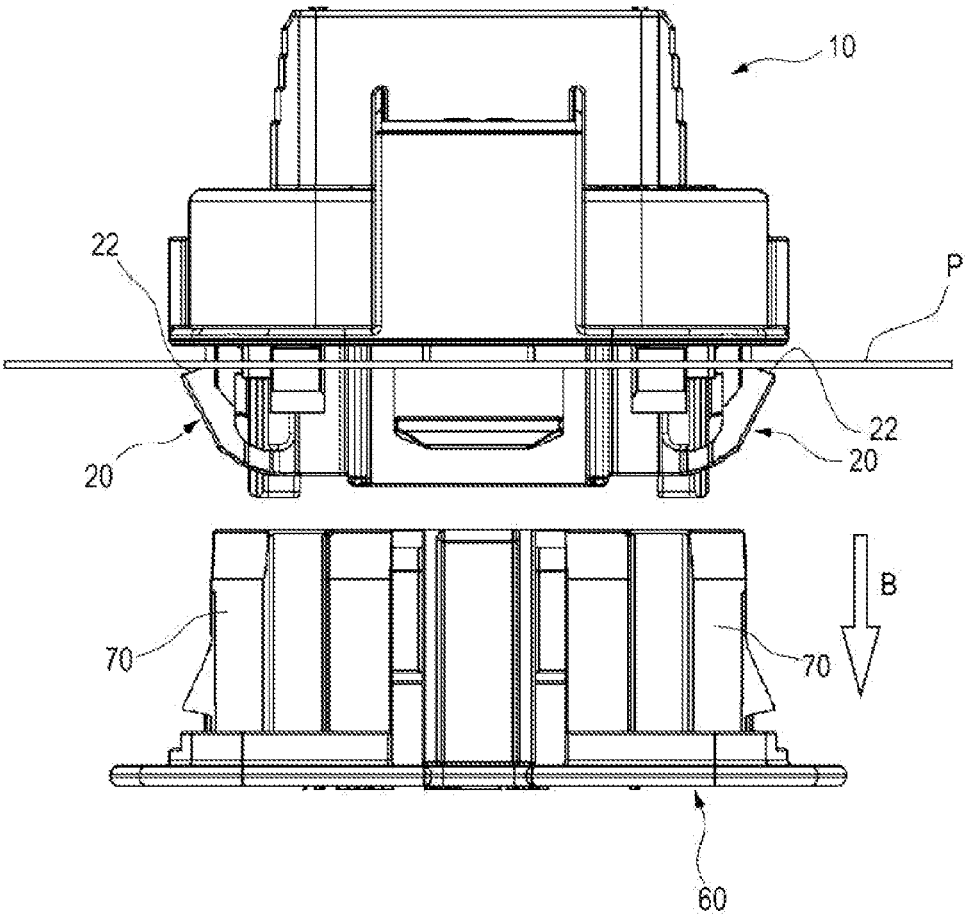
FIG. 11 is a plan view illustrating a state where the second connector housing 60 is separated from the first connector housing 10 as a stage subsequent to FIG. 10.

Therefore, as illustrated in FIG. 10, the temporary locking arm 30 in the locking-released state can be moved to the position that is re-locked to the mounting hole Pa of the panel P, and thus the re-locking can be achieved. As a result, as illustrated in FIG. 11, even when the first connector housing 10 and the second connector housing 60 are separated from each other, the separation of the first connector housing 10 from the panel P can be prevented.

In the above description, the case where the fitting operation is stopped part-way during the fitting operation and the second connector housing 60 is separated from the first connector housing 10 is described. However, even in a case where the second connector housing 60 is separated in a state where the first connector housing 10 and the second connector housing 60 are completely fitted to each other, the separation of the first connector housing 10 from the panel P can be reliably prevented.

In addition, the height of the separation prevention rib 85 is set to a height which allows the separation prevention rib 85 and the engagement portion 31 of the locking arm 30 not to be disengaged from each other until the temporary locking arm 20 is re-locked to the mounting hole Pa of the panel P.

In addition, the present invention is not limited to the above-described embodiment, and modifications, improvements, and the like thereof can be appropriately made. Moreover, the materials, shapes, dimensions, numbers, arrangements, and the like of the elements in the above-described embodiment are arbitrary as long as the present invention is achieved, and are not limited.

Here, the features of the embodiment of the panel fixing type connector device according to the present invention described above are summarized in the following sections [1] and [2].

[1] In the panel fixing type connector device including:

the first connector housing (10) which is mounted in the mounting hole (Pa) of the panel (P) from one side in the direction perpendicular to the panel (P); and the second connector housing (60) which is fitted to the first connector housing (10) with the panel (P) interposed therebetween through the mounting hole (Pa) from the other side in the direction perpendicular to the panel (P), in which, the first connector housing (10) is provided with the temporary locking arms (20) which are bent inward from the initial position as the outer inclined surface (21) of the arm comes into sliding contact with the peripheral edge of the mounting hole (Pa) when the first connector housing (10) is inserted into the mounting hole (Pa) of the panel (P) from the one side, return to the initial positions from the bent positions when the first connector housing (10) is further inserted to a predetermined position so as to allow the locking portion (22) to be locked to the peripheral edge of the mounting hole (Pa), and temporarily lock the first connector housing (10) to the mounting hole (Pa) of the panel (P) in a state of impeding the movement of the first connector housing (10) toward the one side, the second connector housing (60) is provided with the complete fixing portions (75) which are locked to the peripheral edge of the mounting hole (Pa) of the panel (P) to completely fix the second connector housing (60) to the panel (P), and the temporary locking releasing portion (70) which, when the second connector housing (60) is fitted to the first connector housing (10) in a state where the temporary locking arm (20) is locked to the mounting hole (Pa) of the panel (P), allow the temporary locking arms (20) to be bent inward due to the fitting action and thus release the locking of the temporary locking arms (20) to the mounting hole (Pa) of the panel (P), and the first connector housing (10) and the second connector housing (60) are further provided with, the movement restricting and allowing portions (95) which, when the second connector housing (60) is fitted to the first connector housing (10) in a state where the temporary locking arm (20) is locked to the mounting hole (Pa) of the panel (P), restrict the movement of the first connector housing (10) relative to the panel (P) until the first connector housing (10) and the second connector housing (60) are completely fitted to each other, and in a state where the first connector housing (10) and the second connector housing (60) are completely fitted to each other, allow the movement of the first connector housing (10) relative to the panel (P), the main locking portions (90) which allow the first connector housing (10) and the second connector housing (60) to be locked to each other when the first connector housing (10) and the second connector housing (60) are completely fitted to each other, and the separation prevention portion (85) which, when the locking of the temporary locking arm (20) to the mounting hole (Pa) of the panel (P) is released by the temporary locking releasing portion (70) as the second connector housing (60) is fitted to the first connector housing (10) until an intermediate stage in a state where the temporary locking arm (20) is locked to the mounting hole (Pa) of the panel (P), and in this state, the fitting of the first connector housing (10) to the second connector housing (60) is stopped to separate the second connector housing (60) from the first connector housing (10), pulls the first connector housing (10) to the position at which the temporary locking arm (20) in a state where the locking to the mounting hole (Pa) of the panel (P) is released is re-locked to the mounting hole (Pa) of the panel (P) due to the separation operation of the second connector housing (60) so as to allow the temporary locking arm (20) to be re-locked to the mounting hole (Pa) of the panel (P), and thus impedes the separation of the first connector housing (10) from the panel (P).

[2] The panel fixing type connector device described in [1], in which the main locking portions (90) include the locking arm (30) provided in the first connector housing (10) and the locking protrusion (80) provided in the second connector housing (60), when the second connector housing (60) is fitted to the first connector housing (10), part-way during the fitting operation, the locking arm (30) and the locking protrusion (80) interfere with each other such that the locking arm (30) is bent outward from the initial position, when the fitting operation further proceeds and then a completely fitted state is achieved, the locking arm (30) returns to the initial position from the bent position such that the engagement portion (31) provided in the locking arm (30) is engaged with the locking protrusion (80) and accordingly the first connector housing (10) and the second connector housing (60) are locked to each other, when the second connector housing (60) is fitted to the first connector housing (10) in a state where the engagement portion (31) of the locking arm (30) is inserted into the mounting hole (Pa) of the panel (P) and the locking arm (30) and the locking protrusion (80) interfere with each other part-way during the fitting operation so as to cause the locking arm (30) to be bent outward, the engagement portion (31) of the locking arm (30) interferes with the panel (P) such that the locking arm (30) and the locking protrusion (80) restrict the movement of the first connector housing (10) relative to the panel (P) until the first connector housing (10) and the second connector housing (60) are completely fitted to each other, in a state where the first connector housing (10) and the second connector housing (60) are completely fitted to each other, the engagement portion (31) of the locking arm (30) which returns to the initial position from the bent position comes away from the position that interferes with the panel (P) such that the locking arm (30) and the locking protrusion (80) also function as the movement restricting and allowing portions (95) which allows the movement of the first connector housing (10) relative to the panel (P), and the locking protrusion (80) is further provided with, as the separation prevention portion (85), the separation prevention rib (85) protruding therefrom, which, when the locking of the temporary locking arm (20) to the mounting hole (Pa) of the panel (P) is released by the temporary locking releasing portion (70) as the second connector housing (60) is fitted to the first connector housing (10) until an intermediate stage in the state where the locking protrusion (80) is locked to the mounting hole (Pa) of the panel (P), and in this state, the fitting of the second connector housing (60) to the first connector housing (10) is stopped to separate the second connector housing (60) from the first connector housing (10), is engaged with the engagement portion (31) of the locking arm (30) which is bent outward, and thus pulls the first connector housing (10) to the position at which the temporary locking arm (20) in a state where the locking to the mounting hole (Pa) of the panel (P) is released is re-locked to the mounting hole (Pa) of the panel (P) due to the separation operation of the second connector housing (60).

This application is based on Japanese Patent Application (Japanese Patent Application No. 2012-197732), filed on Sep. 7, 2012, the content of which is incorporated herein by reference.

INDUSTRIAL APPLICABILITY

The connector device according to the present invention is useful to provide the panel fixing type connector device which guarantees that the first connector housing is not separated from the panel even in a case where, part-way during the operation of fitting the second connector housing to the first connector housing which is in a state of being temporarily locked to the mounting hole of the panel in advance, the fitting operation is stopped for some reason to separate the second connector housing from the first connector housing.

REFERENCE SIGNS LIST

P PANEL
Pa MOUNTING HOLE
10 FIRST CONNECTOR HOUSING
20 TEMPORARY LOCKING ARM
21 OUTER INCLINED SURFACE
22 LOCKING STEPPED PORTION (LOCKING PORTION)
30 LOCKING ARM
31 ENGAGEMENT PORTION
60 SECOND CONNECTOR HOUSING
70 TEMPORARY LOCKING RELEASING PORTION
75 COMPLETE FIXING ARM (COMPLETE FIXING PORTION)
80 LOCKING PROTRUSION
85 SEPARATION PREVENTION RIB (SEPARATION PREVENTION PORTION)
90 MAIN LOCKING PORTION
95 MOVEMENT RESTRICTING AND ALLOWING PORTION

The invention claimed is:

1. A panel fixing type connector device comprising:

a first connector housing which is mounted in a mounting hole of a panel from one side in a direction perpendicular to the panel; and a second connector housing which is fitted to the first connector housing with the panel interposed therebetween through the mounting hole from the other side in the direction perpendicular to the panel, wherein, the first connector housing is provided with temporary locking arms which are bent inward from initial positions as an outer inclined surface of the temporary locking arm comes into sliding contact with a peripheral edge of the mounting hole when the first connector housing is inserted into the mounting hole of the panel from the one side, return to the initial positions from the bent positions when the first connector housing is further inserted to a predetermined position so as to allow the locking portion to be locked to the peripheral edge of the mounting hole, and temporarily lock the first connector housing to the mounting hole of the panel in a state of impeding movement of the first connector housing toward the one side, the second connector housing is provided with complete fixing portions which are locked to the peripheral edge of the mounting hole of the panel to completely fix the second connector housing to the panel, and temporary locking releasing portions which, when the second connector housing is fitted to the first connector housing in a state where the temporary locking arms are locked to the mounting hole of the panel, allow the temporary locking arms to be bent inward due to the fitting operation and thus release the locking of the temporary locking arms to the mounting hole of the panel, and each of the first connector housing and the second connector housing are further provided with, movement restricting and allowing portions which, when the second connector housing is fitted to the first connector housing in a state where the temporary locking arms are locked to the mounting hole of the panel, restrict the movement of the first connector housing relative to the panel until the first connector housing and the second connector housing are completely fitted to each other, and in a state where the first connector housing and the second connector housing are completely fitted to each other, allow the movement of the first connector housing relative to the panel, main locking portions which allow the first connector housing and the second connector housing to be locked to each other when the first connector housing and the second connector housing are completely fitted to each other, and a separation prevention portion which, when the locking of the temporary locking arm to the mounting hole of the panel is released by the temporary locking releasing portion as the second connector housing is fitted to the first connector housing until an intermediate stage in a state where the temporary locking arm is locked to the mounting hole of the panel, and in this state, the fitting of the first connector housing to the second connector housing is stopped to separate the second connector housing from the first connector housing, engages each other to pull the first connector housing to a position at which the temporary locking arm in a state where the locking to the mounting hole of the panel is released is re-locked to the mounting hole of the panel due to the separation operation of the second connector housing so as to allow the temporary locking arm to be re-locked to the mounting hole of the panel, and thus impedes the separation of the first connector housing from the panel.

2. The panel fixing type connector device according to claim 1, wherein the main locking portions include a locking arm provided in the first connector housing and a locking protrusion provided in the second connector housing, when the second connector housing is fitted to the first connector housing, part-way during the fitting operation, the locking arm and the locking protrusion interfere with each other such that the locking arm is bent outward from an initial position, when the fitting operation further proceeds and then a completely fitted state is achieved, the locking arm returns to the initial position from the bent position such that an engagement portion provided in the locking arm is engaged with the locking protrusion and accordingly the first connector housing and the second connector housing are locked to each other, when the second connector housing is fitted to the first connector housing in a state where the engagement portion of the locking arm is inserted into the mounting hole of the panel and the locking arm and the locking protrusion interfere with each other part-way during the fitting operation so as to cause the locking arm to be bent outward, the engagement portion of the locking arm interferes with the panel such that the locking arm and the locking protrusion restrict the movement of the first connector housing relative to the panel until the first connector housing and the second connector housing are completely fitted to each other, in a state where the first connector housing and the second connector housing are completely fitted to each other, the engagement portion of the locking arm which returns to the initial position from the bent position comes away from a position that interferes with the panel such that the locking arm and the locking protrusion also function as the movement restricting and allowing portions which allow the movement of the first connector housing relative to the panel, and the locking protrusion is further provided with, as a separation prevention portion, a separation prevention rib protruding therefrom, which, when the locking of the temporary locking arm to the mounting hole of the panel is released by the temporary locking releasing portion as the second connector housing is fitted to the first connector housing until an intermediate stage in the state where the locking protrusion is locked to the mounting hole of the panel, and in this state, the fitting of the second connector housing to the first connector housing is stopped to separate the second connector housing from the first connector housing, is engaged with the engagement portion of the locking arm which is bent outward, and thus pulls the first connector housing to a position at which the temporary locking arm in a state where the locking to the mounting hole of the panel is released is re-locked to the mounting hole of the panel due to the separation operation of the second connector housing.

3. The panel fixing type connector device according to claim 2, wherein the height of the separation prevention rib is set to a height which allows the separation prevention rib and the engagement portion of the locking arm not to be disengaged from each other until the temporary locking arm is re-locked to the mounting hole of the panel.

* * * * *